United States Patent [19]

Yogo

[11] Patent Number: 4,933,517

[45] Date of Patent: Jun. 12, 1990

[54] PRESSURE SWITCH WITH REDUCED CONTACT WEAR

[75] Inventor: Kenji Yogo, Aichi, Japan

[73] Assignee: Aisin Seiki Kabushiki Kaisha, Aichi, Japan

[21] Appl. No.: 327,819

[22] Filed: Mar. 23, 1989

[30] Foreign Application Priority Data

Mar. 23, 1988 [JP] Japan ..... 63-37823[U]

[51] Int. Cl.[5] ..... H01H 35/34

[52] U.S. Cl. ..... 200/83 J; 200/83 S

[58] Field of Search ..... 73/717, 723, 745; 340/626; 307/118; 91/1; 92/5 R, 98 R, 99, 101; 200/83 R, 83 A, 83 J, 83 N, 83 S, 83 W

[56] References Cited

U.S. PATENT DOCUMENTS

| | | | |
|---|---|---|---|
| 3,963,887 | 6/1976 | Takusagawa | 200/83 S |
| 4,038,506 | 7/1977 | Filip | 200/83 N |
| 4,644,116 | 2/1987 | Miyakawa | 20/83 J |
| 4,767,898 | 8/1988 | Yasuda | 200/83 N |

FOREIGN PATENT DOCUMENTS

| | | |
|---|---|---|
| 55-21409 | 6/1980 | Japan . |
| 57-19799 | 4/1982 | Japan . |
| 57-48251 | 10/1982 | Japan . |
| 58-6112 | 2/1983 | Japan . |
| 59-36810 | 10/1984 | Japan . |

*Primary Examiner*—Gerald P. Tolin

*Attorney, Agent, or Firm*—Oblon, Spivak, McClelland, Maier & Neustadt

[57] ABSTRACT

An integral housing and body case contain a diaphragm having one side exposed to an external signal pressure and another side exposed to a chamber in the integral housing and body case so that the diaphragm is able to flex in response to a pressure differential between the sides thereof. A rod in the integral housing and body case is movable in response to the flexure of the diaphragm and loosely carries a movable contact which can engage at least one fixed contact in the integral housing and body case. A first spring biases the movable contact toward the at least one fixed contact so that when the rod is moved by a signal pressure, the resulting movement of the movable contact causes the movable contact to engage with the fixed contact and be maintained thereagainst by only the force of the first spring.

12 Claims, 2 Drawing Sheets

PRESSURE SWITCH WITH REDUCED CONTACT WEAR

BACKGROUND OF THE INVENTION

1. Field of the Invention:

The present invention relates to a pressure switch, and more particularly to the pressure switch used for, for example, sensing a load of an oil pressure pump for a power-steering system, an air pressure for a height-control system, and a pressure for an electric skid control system, etc.

2. Background of the Related Art:

A conventional pressure switch is disclosed in Japanese Utility Model Publication No. 32202/1979, and is shown in FIG. 3. There, a diaphragm 56 supports a movable contact 58*a* contacted with the diaphragm 56. A spring 59 downwardly urges the movable contact 58*a*, and a stationary contact 58*b* is fixed to a cover 60.

In the conventional pressure switch, it is only the engagement of the contacts 58*a*, 58*b* which limits the displacement of the diaphragm 56. Therefore, when a high signal pressure is impressed on the diaphragm 56, the contacts 58*a*, 58*b* wear because a high load is applied to the contacts 58*a*, 58*b*, and the diaphragm 56 is damaged by the large transformation thereof.

SUMMARY OF THE INVENTION

Accordingly, it is a primary object of the present invention to isolate both contacts 58*a*, 58*b* from the contact pressure.

It is another object of the present invention to prevent the diaphragm 56 from being damaged.

It is still another object of the present invention to improve the durability of the pressure switch.

The above and other objects are achieved according to the present invention by a pressure switch which comprises an integral housing and body case within which is fixed a diaphragm having one side exposed to an external signal pressure and another side exposed to a chamber in the integral housing and body case so that the diaphragm is able to flex in response to a pressure differential between the sides thereof. A rod in the integral housing and body case is movable in response to the flexure of the diaphragm and loosely carries a movable contact which can engage at least one fixed contact in the integral housing and body case. A first spring means biases the movable contact toward the at least one fixed contact so that when the rod is moved by a signal pressure, the resulting movement of the movable contact causes the movable contact to engage with the fixed contact and be maintained thereagainst by only the force of the first spring means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
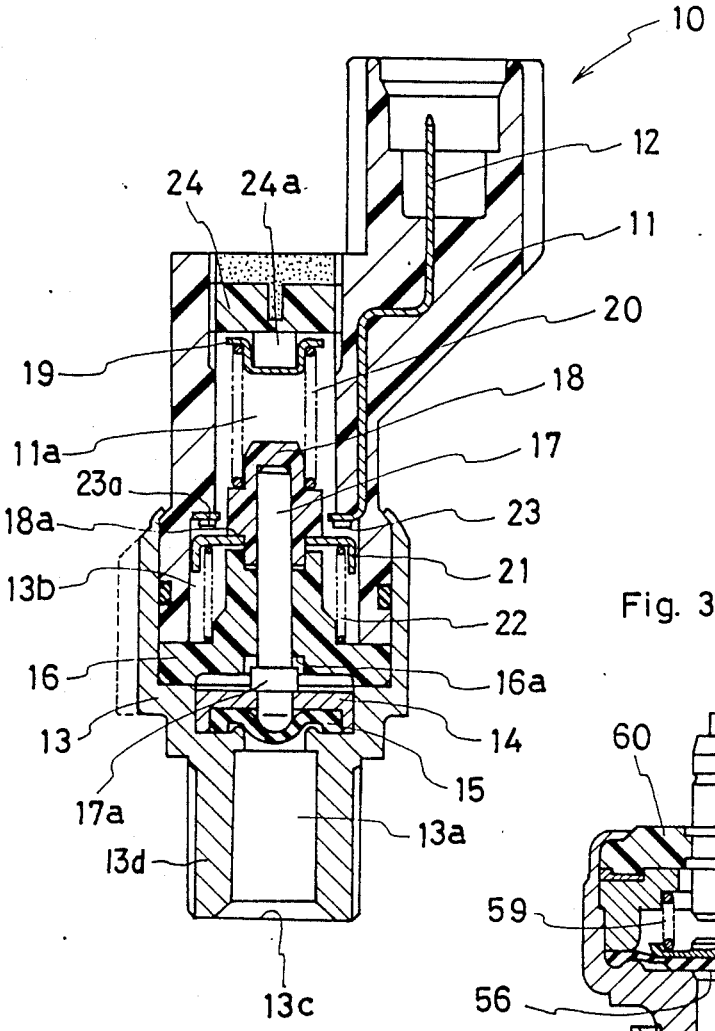
FIG. 1 is a cross-sectional view of one embodiment of a pressure switch according to the invention.
Figure 3:
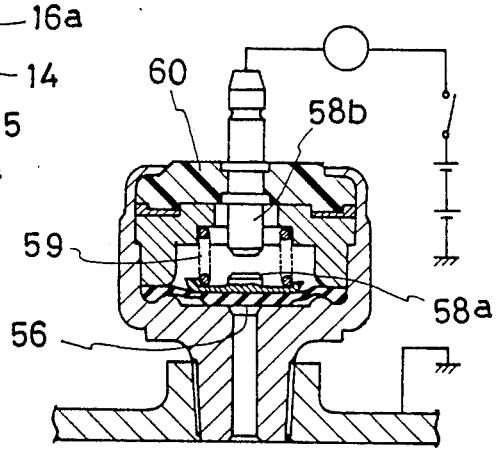
Fig. 3 (PRIOR ART)
FIG. 3 is a view similar to FIG. 1, but showing a conventional pressure switch.

Referring first to the embodiment of the invention shown in FIG. 1, a pressure switch 10 includes a molded housing 11 holding a pair of terminals 12 (only one is shown). The housing 11 is integrally connected to the metallic body case 13. The body case 13 is provided with an extension 13*d* which defines a signal pressure chamber 13*a*, and the body case and housing together enclose a sealed chamber 13*b*. An opening 13*c* is formed at one end of the extension 13*d* and forms an outlet for the signal pressure chamber 13*a*. A diaphragm 15 is sealingly disposed between the signal pressure chamber 13*a* and the chamber 13*b*, and is supported by a diaphragm holder 14 fixed in the body case. A rod 17 is axially slidably supported in the chamber 13*b* by a stationary element in the form of a rod holder 16 which is fixedly held in the chamber 13*b* between shoulders of the housing 11 and the body case 13. An annular recess 16*a* is located at lower portion of the rod holder 16.

One end of the rod 17 passes through an aperture in the diaphragm holder 14 and is contacted with the diaphragm 15. A stopper 17*a* in the form of an annular enlargement of the rod 17 is provided at lower portion of the rod 17 and limits the rod 17 in downward and upward movement. The other end of the rod 17 is fixedly inserted into a spring holder 18. A contact plate 21 is provided in the chamber 13*b* and loosely held by rod 17 via the spring holder 18. A radially inner portion of the contact plate 21 is circumferentially contacted with shoulder 18*a* defined by an outer circumferential portion of the spring holder 18. A spring 22 is interposed between the rod holder 16 and the contact plate 21. The spring 22 urges the contact plate 21 against the shoulder 18*a* of the spring holder 18. A pair of stationary contacts 23 and 23*a* are positioned above the contact plate.

The housing 11 has a through hole 11*a*. At one end of the through hole 11*a*, a spring adjuster 24 is fixed by a screw connection with the housing 11. A retainer 19 is located at a projecting portion 24*a* of the spring adjuster 24. A spring 20 is interposed between the spring holder 18 and the retainer 19 and has sufficient force to overcome the force of spring 22 and normally press the stopper 17*a* against the diaphragm holder 14 as shown in FIG. 1, thereby cooperating with the shoulder 18*a* for maintaining the contacts 21 and 23,23*a* spaced from one another.

Each of the terminals 12 is connected to one of the stationary contacts 23, 23*a*. The stationary contacts 23, 23*a* are opposedly located adjacent the base of the through hole 11*a*.

The diaphragm 15 is made of a high hardness material, i.e., one capable of moving the rod 17 without damage thereto, such as butadiene-acrylonitrile rubber. But the diaphragm can instead be made with at least one portion contacted with the rod 17 made of a high hardness material (as is the diaphragm holder 14) and other portion of the diaphragm 15 made of a low hardness material.

The operation according to the first embodiment is described hereinafter.

The extension 13*d* is threaded into a part capable of producing a signal pressure. When a signal pressure is applied in the signal pressure chamber 13*a*, the diaphragm 15 is pushed upwardly. When the signal pressure is greater than the downward load due to the spring 20, the diaphragm 15 is moved upwardly. Therefore, the rod 17 is also moved upwardly and the stopper 17*a* of the rod 17 separates from the diaphragm holder 14. The contact plate 21 is upwardly moved by the spring 22 in accordance with the upward movement of the rod 17 and contacts with the stationary contacts 23, 23*a* before the rod is stopped by the stopper 17*a*, so that one of the stationary contacts 23 is in electrical continuity with the other of the stationary contacts 23 via the contact plate.

The contact load between the contact plate 21 and the stationary contacts 23, 23*a* is determined only by the force of the spring 22 and is set to be a predetermined force of about 100 grams, which is a very low load, but one which can sufficiently contact the contact plate 21 and the stationary contacts 23, 23*a* to provide good electrical continuity. Therefore, the friction generated between the contact plate 21 and the stationary contacts 23, 23*a* is low in view of the above-mentioned low contact load.

When the signal pressure is very large, the rod (but not the contact plate 21) continues to move upward until the stopper 17*a* of the rod 17 contacts with the upper surface of the recess 16*a* of the rod holder 16, so that further upward movement of the rod 17 is stopped and damage to the diaphragm is prevented. The contact plate 21 has then separated from the spring holder 18, so that the signal pressure does not act on the contact plate 21.

Figure 2:
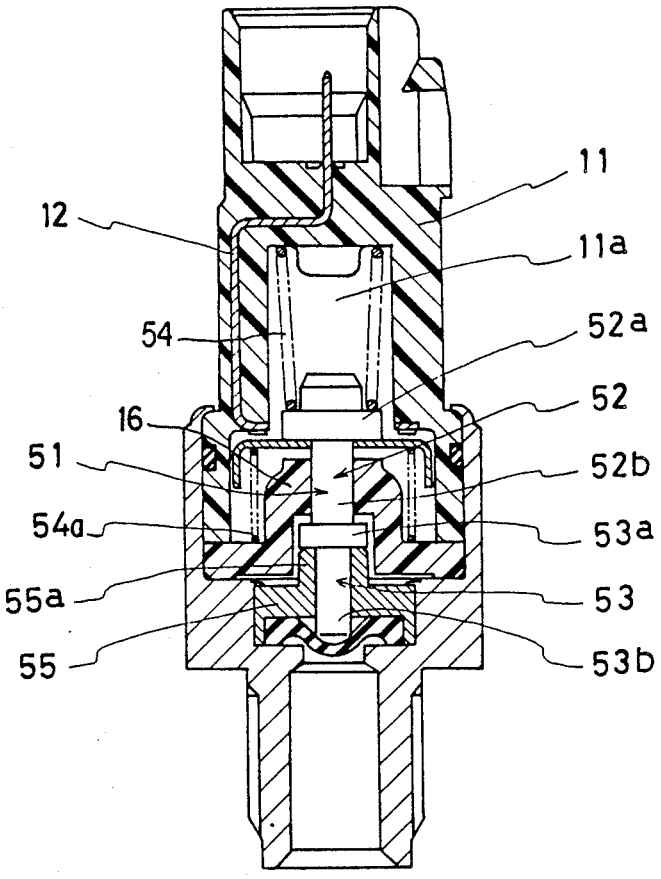
FIG. 2 is a view similar to FIG. 1, but showing another embodiment according to the invention.

Next, referring to FIG. 2 which shows a pressure switch 50 of a second embodiment according to the present invention, only the different construction from the first embodiment will be described hereinafter:

A rod 51 includes an upper rod portion 52 and a lower rod portion 53. The upper rod portion 52 has an enlarged annular spring holder portion 52*a* and a rod portion 52*b*. The lower rod portion 53 has an enlarged annular stopper portion 53*a* and a rod portion 53*b*.

A spring 54 is interposed between the spring holder portion 52*a* and the upper end surface formed in the through hole 11*a* of the housing 11. A spring 54 corresponds to sring 22 of the first embodiment.

A diaphragm holder 55 has an upwardly extending flange portion 55*a*. The diaphragm holder 55 guides the movement of the rod portion 53*b* of the lower rod portion 53 therein.

One end of each of the terminals 12 is located at an upper end portion of the housing.

The retainer 19 shown in FIG. 1 of the first embodiment is omitted in this embodiment.

Since the rod 51 is separated into the upper rod portion 52 and the lower rod portion 53, even if the axial center of the rod holder 16 is different from the axial center of the diaphragm holder 55, there is no negative influence on the movement of the rod 51. As a result, the sliding between the rod portion 52*b* and the rod holder 16 and between the rod portion 53*b* and the diaphragm holder 55 is smoothly carried out.

The operation according to the second embodiment is similar to that in FIG. 1, and so it will not be further explained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A normally open pressure switch comprising:

an integral housing and body case;

a diaphragm fixed in said integral housing and body case, said diaphragm having one side exposed to an external signal pressure and another side exposed to a chamber in said integral housing and body case, whereby said diaphragm flexes in response to a pressure differential between the sides thereof;

a rod in said integral housing and body case, said rod being movable in response to the flexure of said diaphragm;

at least one fixed contact in said integral housing and body case;

a movable contact loosely carried with said rod; and means for maintaining said movable contact spaced from said fixed contact when said signal pressure is not applied to said one side of said diaphragm;

first spring means pressed between said movable contact and a stationary element in said integral housing and body case and expandable for biasing said movable contact towards said at least one fixed contact with a predetermined force sufficient to provide good electrical continuity between said fixed and stationary contacts, whereby said signal pressure moves said movable contact into engagement with said at least one fixed contact while said first spring expands and said movable contact is maintained in engagement with said at least one fixed contact by only the predetermined force of said expanded first spring.

2. The switch of claim 1 wherein said means for maintaining comprises means defining a shoulder fixed to said rod, wherein said first spring means biases said movable contact into engagement with said shoulder, whereby said movable contact separates from said shoulder when said movable contact is moved into engagement with said at least one fixed contact.

3. The switch of claim 2 wherein said rod engages said diaphragm.

4. The switch of claim 3 including stopper means for limiting said movement of said rod in response to the flexure of said diaphragm.

5. The switch of claim 4 wherein said means for maintaining further comprises second spring means biasing said rod in a direction opposite to the direction of movement of said rod in response to the flexure of said diaphragm.

6. The switch of claim 3 wherein said stopper means and said at least one fixed contact are positioned such that said movable contact engages said at least one fixed contact before movement of said rod is limited by said stopper means.

7. The switch of claim 4 including a diaphragm holder in said integral housing and body case.

8. The switch of claim 2 wherein the diaphragm is made of a high hardness material capable of moving the rod without damage to the diaphragm.

9. The switch as set forth in claim 2 wherein at least one portion of said diaphragm is contacted with said rod and is made of a high hardness material capable of moving the rod without damage to the diaphragm.

10. A pressure switch as set forth in claim 9 wherein an outer portion of said diaphragm is made of a low hardness material as compared to said high hardness material.

11. A pressure switch as set forth in claim 1 including two of said fixed contacts.

12. A pressure switch as set forth in claim 2 wherein said means defining a shoulder comprise a spring holder fixed to said rod.

* * * * *